US005566905A

United States Patent [19]

Iwade et al.

[11] Patent Number: 5,566,905

[45] Date of Patent: Oct. 22, 1996

[54] APPARATUS FOR WINDING A PLURALITY OF YARNS

[75] Inventors: Takashi Iwade, Kyoto; Jun Takagi; Yoshiro Migaki, both of Otsu, all of Japan

[73] Assignee: Toray Engineering Co., Ltd., Japan

[21] Appl. No.: 211,671

[22] PCT Filed: Aug. 19, 1993

[86] PCT No.: PCT/JP93/01163

§ 371 Date: Apr. 12, 1994

§ 102(e) Date: Apr. 12, 1994

[87] PCT Pub. No.: WO94/04452

PCT Pub. Date: Mar. 3, 1994

[30] Foreign Application Priority Data

| | | | |
|---|---|---|---|
| Aug. 19, 1992 | [JP] | Japan | 4-244240 |
| Oct. 9, 1992 | [JP] | Japan | 4-297885 |

[51] Int. Cl.[6] ..... B65H 54/28

[52] U.S. Cl. ..... 242/43 A; 242/158 R

[58] Field of Search ..... 242/18 G, 43 A, 242/158 R, 18 A

[56] References Cited

U.S. PATENT DOCUMENTS

| | | | |
|---|---|---|---|
| 4,230,284 | 10/1980 | Cunningham et al. | 242/18 A |
| 4,300,728 | 11/1981 | Andre et al. | 242/18 A |
| 4,417,700 | 11/1983 | Ueda et al. | 242/18 A |
| 4,505,437 | 3/1985 | Schippers et al. | 242/43 A |
| 4,646,983 | 3/1987 | Schippers et al. | 242/43 A |
| 4,674,694 | 6/1987 | Hasegawa et al. | 242/43 A |
| 4,991,783 | 2/1991 | Sugioka | 242/43 A |
| 5,176,330 | 1/1993 | Tone | 242/43 A |
| 5,308,004 | 5/1994 | Ukai et al. | 242/18 A |

FOREIGN PATENT DOCUMENTS

| | | | |
|---|---|---|---|
| 114641 | 8/1984 | European Pat. Off. | 242/43 A |
| 114642 | 8/1984 | European Pat. Off. | 242/43 A |
| 3345237 | 6/1985 | Germany | 242/43 A |
| 3826130 | 2/1989 | Germany . | |
| 4142886 | 7/1992 | Germany . | |
| 47-12898 | 4/1972 | Japan | 242/43 A |
| 59-194977 | 11/1984 | Japan . | |
| 61-257867 | 11/1986 | Japan . | |

*Primary Examiner*—William Stryjewski
*Attorney, Agent, or Firm*—Austin R. Miller

[57] ABSTRACT

To provide a traverse-motion mechanism capable of easing the threading operation by reducing the heights of the yarn-separating fulcrum and the godet roller disposed upstream of a yarn-traversing fulcrum, of reducing times required for the manufacturing and assembling operation by simplifying the structure due to the reduction of the overall machine height, of minimizing the rise of selvage and ribbon wind generated in a package, and of readily adjusting the position of yarn turning point. A traversing unit 6-1 disposed at one end of the traverse-motion mechanism is offset from a regular position toward another traversing unit 6-4 so that a straight line connecting the opposite traverse ends (A) and (B) in the traversing unit 6-1 with each other is not parallel to an axis of a touch roller 7. In the traversing unit 6-1, three blades 15-1 through 15-3 are fixed on a first rotor 13 and two blades 20-1 and 20-2 are fixed on a second rotor 18 at equiangular positions in a rotary plane thereof, while the rotary centers of the first and second rotors 13, 18 are defined so that a rotary angle of the respective rotor, through which the yarn is conveyed by one blade on the one rotor while being in contact with the yarn-guiding surface 23 until released therefrom, is about 60° in the first rotor 13 and 90° in the second rotor 18 and a rotational ratio of the first rotor 13 relative to the second rotor 18 is 2:3.

8 Claims, 14 Drawing Sheets

APPARATUS FOR WINDING A PLURALITY OF YARNS

TECHNICAL FIELD

The present invention relates to an apparatus, for winding a plurality of yarns, having a traverse-motion mechanism in which a plurality of traversing units are provided each reciprocating a yarn by means of a plurality of blades secured to a pair of rotors.

BACKGROUND ART

Generally speaking, for taking up yarns extruded from a spinning machine a yarn winder is used. The yarn winder comprises a spindle rotatably carried on a machine frame for carrying bobbins and a traverse-motion mechanism mounted on the machine frame above the spindle while being movable upward and downward or a turret type yarn winder in which a plurality of spindles for carrying bobbins are rotatably carried on a turret member which, in turn, is rotatably mounted on a machine frame.

A traverse-motion mechanism used for a high-speed winder comprises a plurality of traversing units, each consisting of a pair of rotors carried on a frame at a distance from each other, a plurality of blades secured onto the respective rotor, and a yarn guide fixed to the frame so as to be located in the path of a yarn-guiding edge of the blade. The traversing units are arranged at a predetermined pitch in the lengthwise direction of the bobbin-carrying spindle, while a touch roller is rotatably carried on the frame close to the blade of the respective traverse unit at a position downstream thereof.

The blades are positioned around the rotor at an angular pitch of 180° and 120° when the number of blades is two and three, respectively. A pair of rotors, each provided with the same number of blades, are secured on the frame at a distance therebetween and rotatable in the reverse direction to each other.

A traverse-motion mechanism having a plurality of such traversing units is disclosed, for example, in Japanese Examined Patent Publication Nos. 3-72544 (corresponding to the U.S. Pat. No. 4,505,436) and 4-27151 (corresponding to the U.S. Pat. No. 4,505,437).

Recently, spindles tend to be lengthened to increase the number of bobbins (four through eight) to be carried thereon for the purpose of increasing yarn-winding capacity.

The lengthening of spindle, however, causes the increase of a yarn bending angle at a yarn-separating fulcrum directly beneath a godet roller on the upstream side toward a yarn-traversing fulcrum positioned at the respective end of the spindle, which, in turn, results in the deterioration of yarn quality due to the increase of running resistance at the fulcrum. In addition, since the yarn is taken up by a higher winding tension, a yarn package thus obtained is difficult to unwind.

According to the abovesaid limitation of the yarn bending angle at the yarn-separating fulcrum toward the yarn-traversing fulcrum, it is impossible to shorten the distance between the traversing unit and the yarn-traversing fulcrum and that between the yarn-traversing fulcrum and the yarn-separating fulcrum disposed upstream thereof. This increases a height of the yarn-separating fulcrum disposed upstream of the yarn-traversing fulcrum and that of the godet roller disposed at further upstream position, whereby the threading operation becomes difficult. In addition, there is a problem in that a total height of the machine increases, whereby it can be installed only in a building having a high ceiling.

According to the abovesaid traverse-motion mechanism, since the blades mounted on the respective rotors have the same diameter (D) and the rotors are positioned at a distance in the bobbin axial direction. When the first and second rotors are driven from the same side, as shown in FIG. 14, a pitch L between the adjacent traversing units cannot exceed a sum of an outer diameter D of the blades of the rotor and a diameter d of a rotor shaft, i.e., (D+d)/2. For example, if it is assumed that a traversing stroke W is 250 mm, the outer diameter D of blades is 540 mm and the diameter d of a rotor shaft is 30 mm, the pitch L of the traversing units is determined by the following formula:

$$L = (D+d)/2 \text{ (mm)} \quad (1)$$
$$L = (540+30)/2$$
$$= 285 \text{ (mm)}$$

On the other hand, a gap of about 25 mm is sufficient between the adjacent full packages for manipulating them.

This means that a length of 10 mm obtained by subtracting a sum of the traversing stroke W (250 mm) and the indispensable gap (25 mm) from the pitch L (285 mm) is excessive. Due to this excessive length, longer bobbins and a long spindle must be used, whereby an increase in yarn winding speed is restricted.

In addition, since the distance between the rotors in the respective traversing unit is very short, it is hardly possible to directly transmit the rotation of one rotor to the other. Accordingly the each of them must be adapted to intermesh with a common intermediate gear through a gear fixed with the respective rotor so that one rotor is rotatable when the other rotor is driven by a common driving mechanism.

There are problems, inherent to the provision of an intermediate gear or the like, of the structural complexity and the need of time for the production of parts, assembly and maintenance thereof.

A yarn package taken up via the abovesaid traverse-motion mechanism has the drawback of an increase in package selvage and ribbon wind because the turning points of the traversing stroke and a running trace of yarn are constant from the initiation to the completion of the package formation.

Accordingly, to minimize the increase in package selvage and the ribbon wind, a method is proposed for providing a plurality of turning points and running traces of yarn, by using a rotor with blade, each having a yarn-guiding edge different from the other (which is called a "selvage-rise flattening method").

Such a traverse-motion mechanism for providing a plurality of turning points is described, for example, in Japanese Examined Patent Publication (Kokoku) No. 49-2394.

The method adopting such the blades, each having a different shape from the other, has drawbacks in that the number of turning points is at most equal to that of blades, a stepped selvage is liable to occur when the number of turning points is as few as two or three, and the traverse-motion mechanism becomes too large to put into practice when as many as six through eight blades are used to minimize the rise of selvage.

Accordingly, the first problem to be solved by the present invention is the difficulty of the threading operation due to the increase of distance of yarn-separating fulcrum or godet roller from a yarn-traversing fulcrum disposed downstream thereof.

A second problem is that the winder becomes too large to be installed in a building except for one having a particularly high ceiling.

A third problem is that, since the pitch of traversing units cannot be shortened, unfavorably longer bobbins and spindles must be used.

A fourth problem is that, since the distance between axes of the adjacent rotors is very small in a traverse-motion mechanism having a pair of rotors, each provided with the same number of blades, such as two or three, it is necessary to provide a part such as an intermediate gear for driving one rotor by the other rotor, which increases the complexity of the structure and results in an increase in time for the production of parts, and assembly and maintenance thereof.

A fifth problem is that the number of turn points is at most three even if each of three blends has a yarn-guiding edge with a different shape from the other, whereby it is impossible to minimize the rise of package selvage and the ribbon wind to an extent not influencing the package quality.

A sixth problem is that a turning point cannot be changed unless a blade is replaced with a new one.

DISCLOSURE OF THE INVENTION

To solve the first and second problems, an apparatus for winding a plurality of yarns according to the present invention is provided, in which a traversing unit disposed at least one end of the apparatus is offset in a plane intersecting the yarn running direction at a position where a yarn is in contact with a traverse guiding element so that a line connecting the opposite ends of a traversing zone in the traversing unit is not parallel to an axis of a touch roller.

To solve the third problem, a traversing unit according to the present invention comprises a first rotor with m blades and a second rotor with n blades ($n \neq m$), wherein any adjacent two such traversing units are symmetrically arranged relative to an axis vertical to the yarn traversing direction and the first and second rotors in one traversing unit rotate in reverse to the rotors in the other traversing unit, and wherein axes of the first and second rotors in one traversing unit are distant from each other in the direction generally vertical to an axis of a bobbin-carrying spindle.

Also, a traversing unit preferably comprises a pair of rotors rotatably secured on a frame, a plurality of blades attached on the respective rotors, and a yarn guiding element attached to the frame along a rotary path of the blades.

To solve the fourth problem, a traversing unit according to the present invention has m blades on the first and n blades on the second rotor ($m \neq n$) arranged at equi-angular positions on a rotary circle thereof, and the rotational centers of the first and second rotors are defined so that a rotary angle is about 360°/2 m in the first rotor and about 360°/2 n in the second rotor, which angle is passed by a blade of one rotor when it displaces a yarn running while being in contact therewith along the yarn guiding element until the yarn is transferred to a blade of the other rotor, and in which a rotational ratio between the first and second rotors is defined to be n:m.

To solve the fifth problem, a traversing unit according to the present invention has m blades on the first rotor and n blades on the second rotor ($m \neq n$) and yarn-guiding edges formed on distal ends of the respective blades are arranged at positions different from and offset from equiangular positions on a circle in a rotary plane.

To solve the sixth problem, a traversing unit according to the present invention is adapted to be capable of adjusting a mounting position of blades with reference to guiding portions formed on the first and second rotors.

BEST MODE FOR CARRYING OUT THE INVENTION

Figure 1:
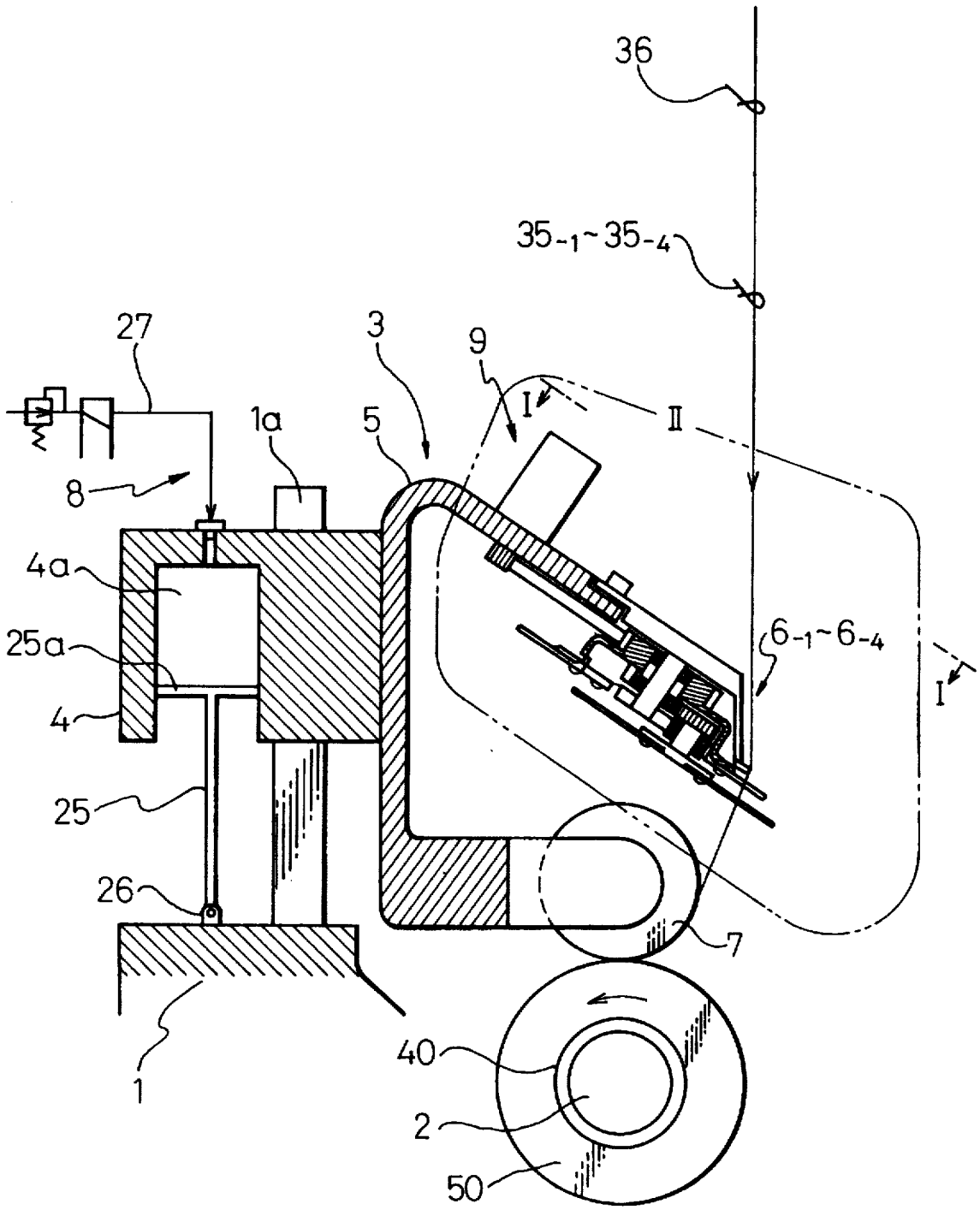
FIG. 1 is a diagrammatic cross-sectional view illustrating one embodiment of an apparatus for winding a plurality of yarns according to the present invention.
Figure 2:
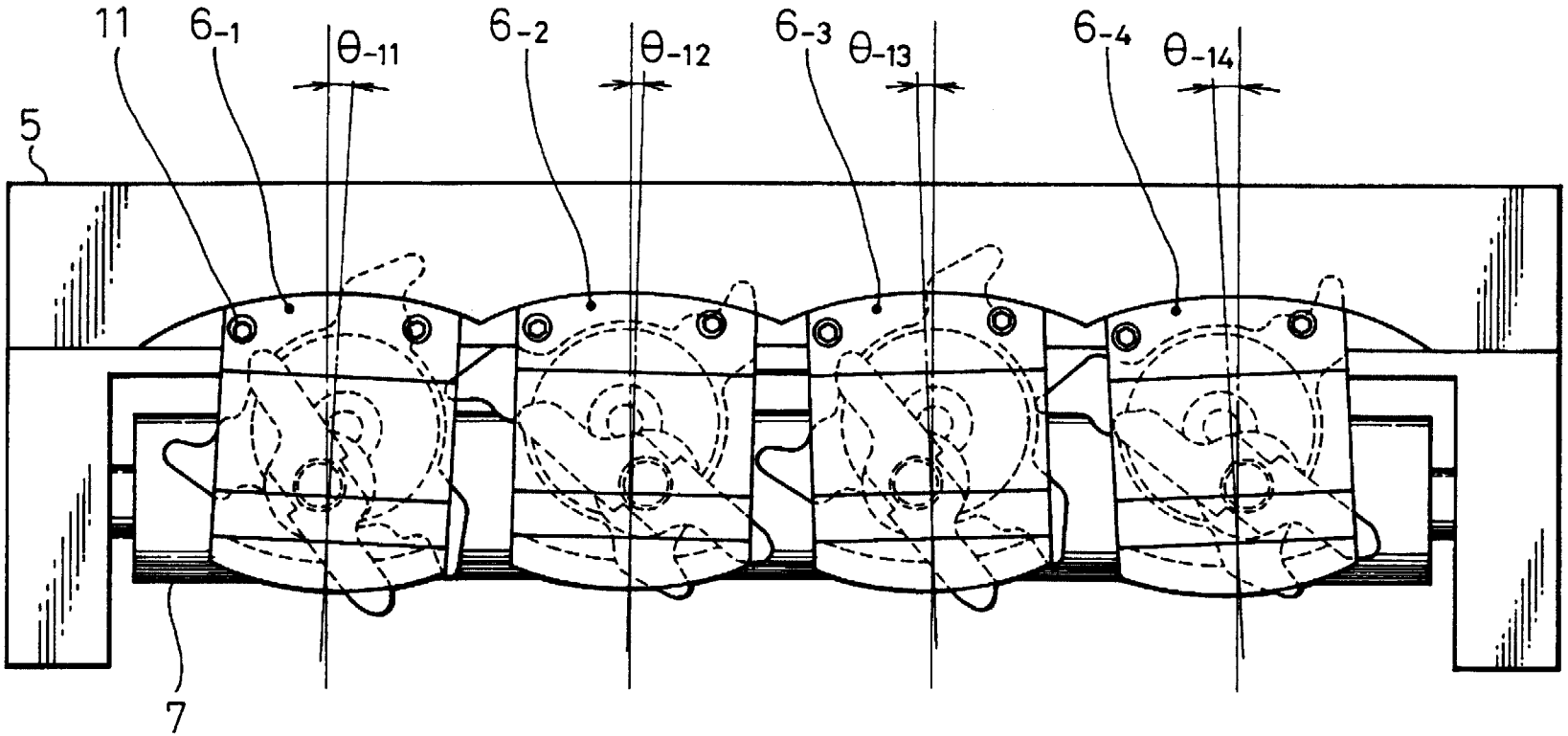
FIG. 2 is a view seen in the arrowed direction I—I of FIG. 1.

As shown in FIG. 1 illustrating a diagrammatic overall view of one embodiment of an apparatus for winding a plurality of yarns according to the present invention and FIG. 2 illustrating a view seen from the arrowed direction I—I in FIG. 1, the winding apparatus includes a bobbin-carrying spindle 2 rotatably secured onto a machine frame 1 in a horizontal position and a traverse-motion mechanism 3 disposed above the spindle 2 and carried on a guiding pillar 1*a* attached on the machine frame 1 while being movable upward and downward. Yarn-traversing fulcrums 35-1 through 35-4 and a yarn-separating fulcrum 36 are provided above the traverse-motion mechanism 3.

The traverse-motion mechanism 3 includes a slider 4 movable upward and downward while being engaged with the guiding pillar la provided on the machine frame 1, a frame body 5 fixed to the slider 4 and extending above and parallel to a spindle 2 rotatably secured on the machine frame 1 in a horizontal position, a plurality of traversing units 6-1 through 6-4 arranged on the frame body 5 in the longitudinal direction of the spindle 2 at a pitch between every adjacent units, a plurality of touch rollers 7 rotatably attached to the frame body 5 in parallel to the spindle 2, a contact pressure mechanism 8 for applying a predetermined pressure to a bobbin 40 or a package 50 carried on the spindle 2, and a drive mechanism 9 for rotating the traversing units 6-1 through 6-4.

Figure 3:
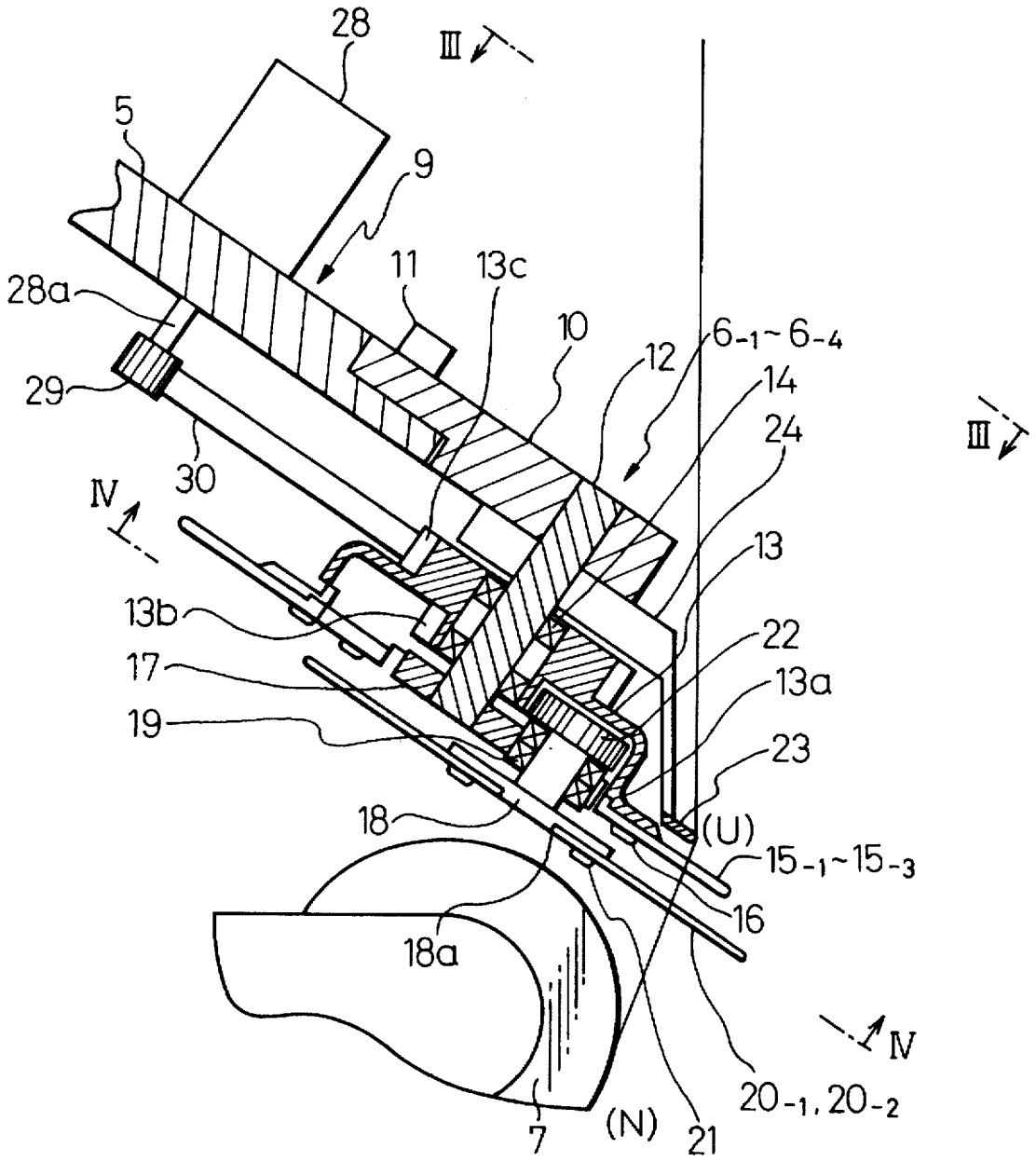
FIG. 3 is an enlarged view of area II of FIG. 1.
Figure 4:
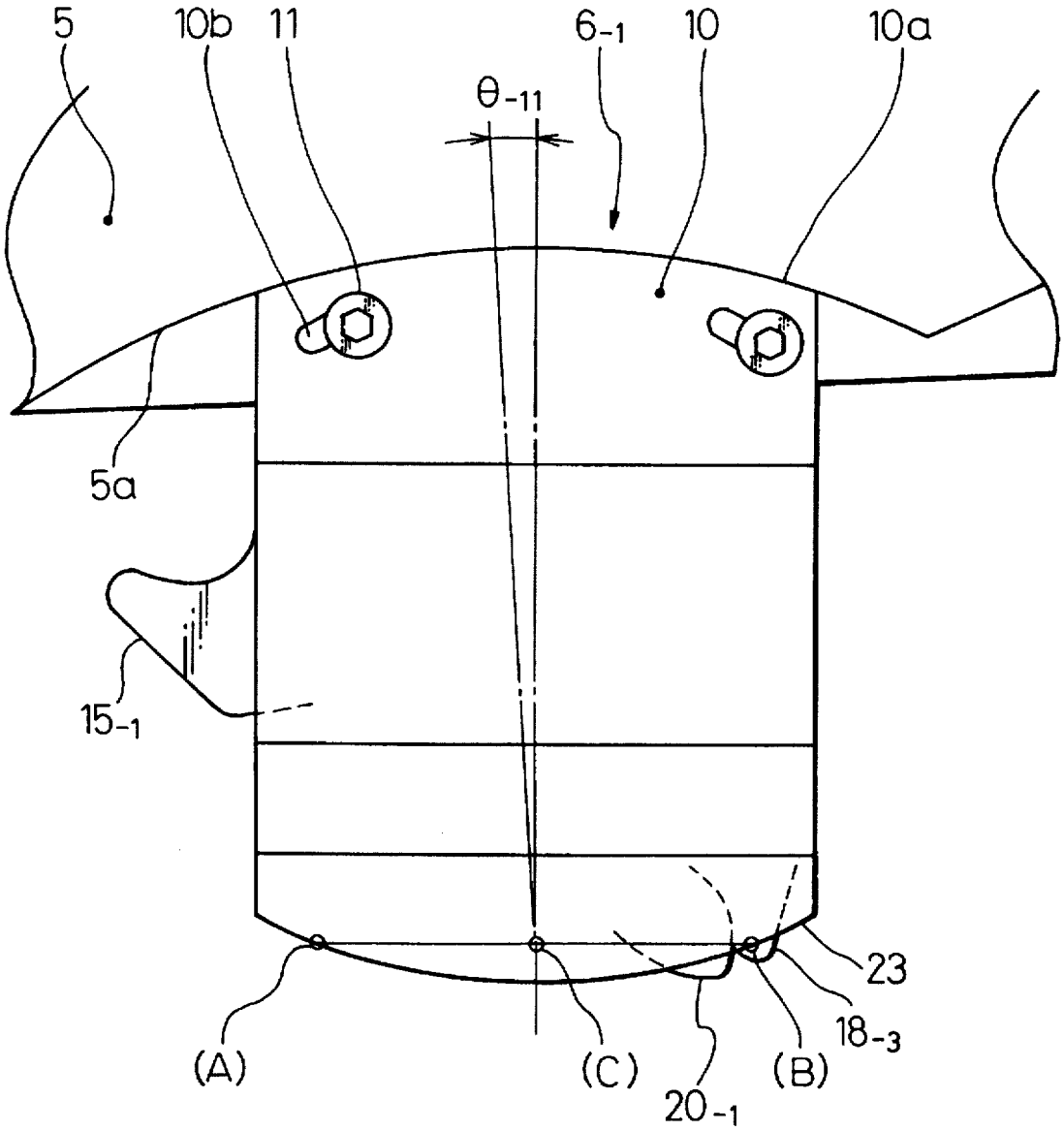
FIG. 4 is a view seen in the arrowed direction III—III of FIG. 3.
Figure 5:
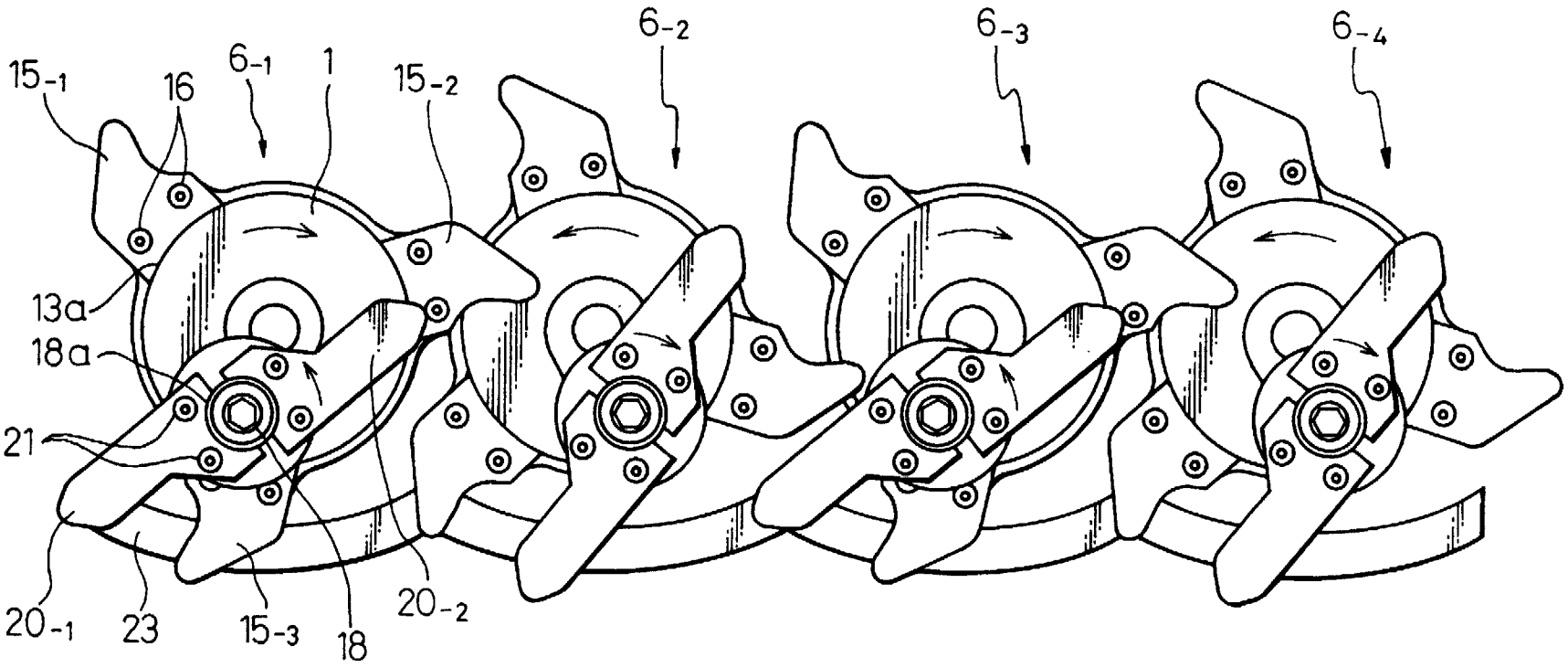
FIG. 5 is an overall view seen in the arrowed direction IV—IV of FIG. 3.

As shown in FIGS. 3 and 4, each of the abovesaid traversing units 6-1 through 6-4 includes a support 10 fixed to the frame body 5 by a screw 11, a first rotor 13 rotatably secured, via a bearing 14, to a shaft 12 projected from the support 10, a plurality of blades 15-1 through 15-3 fixed by screws 16 to the first rotor 13, while being engaged with a circular recess **13*a* formed thereon, at about 120° angular pitch therebetween as seen in a rotary plane, a second rotor 18 rotatably secured, via a bearing 19, to a support 17 fixed to the distal end of the shaft 12, a plurality of blades 20-1 and 20-2 fixed by screws 21 to the second rotor 18, while abutting a circular protrusion 18*a* formed thereon, at about 180° angular pitch therebetween as seen in a rotary plane, a gear 22 integrally mounted to a distal end of the second rotor 18 to be meshed with a gear 13*b* formed at one end of the first rotor 13, and a yarn-guiding surface 23 attached to the support 10 by a bracket 24 to be positioned in a rotary path of each of the blades 15-1 through 15-3 and that of each of the blades 20-1 and 20-2**.

An arcuate stepped portion **5*a* is formed on the frame body 5, having a center at a middle point C between the opposite ends A and B of a yarn-traversing path on the yarn-guiding surface 23, on which the yarn repeats the traverse motion while being in contact therewith. Also an arcuate terminal portion 10*a* is provided on the support 10 to be brought into surface contact with the arcuate stepped portion 5*a* formed on the frame body 5. In this regard, openings 10*b* for setting the screws 11** have an elongated shape.

In the adjacent traversing units in 6-1 through 6-4, the rotor 13 rotates in the reverse direction to the rotor 18, and the shape of the respective blade 15-1 through 15-3 and that of the respective blade 20-1 and 20-2 in one traversing unit are symmetrical to those of the other.

The contact pressure mechanism 8 consist of a piston 25 having a head **25*a* movably fitted in an air chamber 4*a* formed in the slider 4 and a lower end attached to the machine frame 1 via a bracket 26, and a compressed air supply conduit 27 connected with the air chamber 4*a* of the slider 4** and having a pressure regulating valve, an electromagnetic selector valve or other.

When high pressure air is supplied into the air chamber **4*a* in the slider 4, the touch roller 7 attached to the frame body 5 together with the slider 4 is elevated to reduce the contact pressure against the spindle 2**, and, on the contrary, when low pressure air is supplied, the elevating force is reduced to increase the contact pressure.

The drive mechanism 9 consists of a motor 28 mounted onto the frame body 5, a toothed pulley 29 attached to an output shaft **28*a* of the motor 28, and a toothed belt 30 wrapped around a toothed pulley 13*c* fixed on the first rotor 13 of each of the traversing units 6-1 through 6-4**.

When the motor 28 operates to rotate the first rotor 13 of the respective traversing unit 6-1 through 6-4, the second rotor 18 is made to rotate via a gear **13*b* of the first rotor 13 and the gear 22**.

The attachment of blades 15-1 through 15-3 to the first rotor 13 and blades 20-1 and 20-2 to the second rotor 18 in the traversing units 6-1 and 6-3 is carried out as follows:

The explanation will be made of the traversing unit 6-1.

Figure 6:
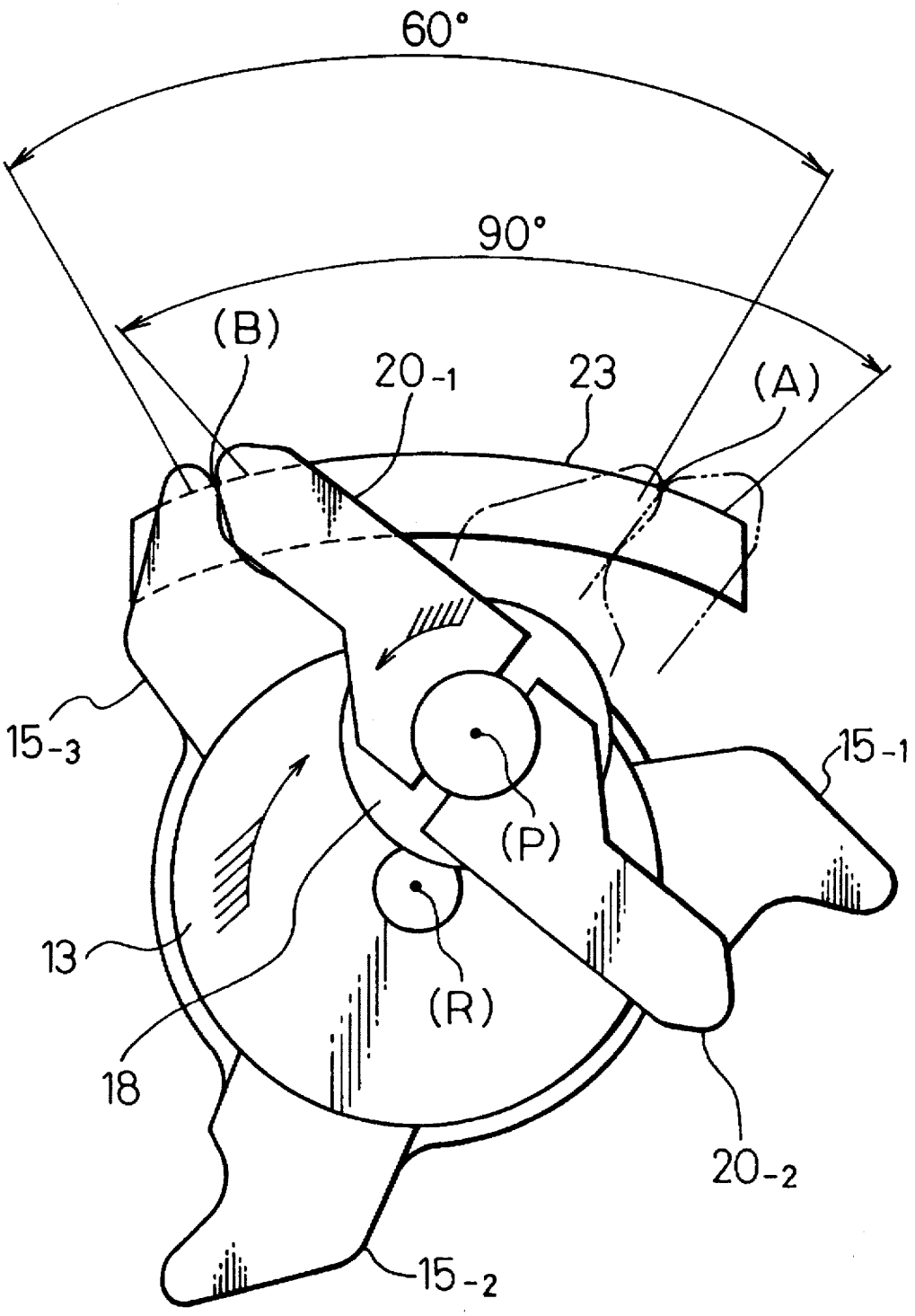
FIG. 6 is a diagrammatic view illustrating the positional relationship between the respective rotors and the blades.

First, for temporarily positioning blades, as shown in FIG. 6, a position of point P is defined so that a rotary angle of the blade 20-1 or 20-2 is 90 from a first yarn-transfer position A to a second yarn-transfer position B when the blades 20-1 and 20-2 are attached to the second rotor 18 at an angular pitch of 180° as seen in a rotary plane thereof, i.e., in a point-symmetrical manner having a center at point P and the blades 15-1 through 15-3 are attached to the first rotor 12 at an angular pitch of 120° as seen in a rotary plane thereof. Also positions of a point R and the yarn-guiding surface 23 are defined so that a rotary angle of the blade 15-1 or 15-3 from the second yarn-transfer position B to the first yarn-transfer position A is 60°.

The point P is a rotary center of the second rotor 18 and the point R is a rotary center of the first rotor 13.

The numbers of the gear **13*a* formed on the first rotor 13 and of the gear 22 fixed to the second rotor 18 are decided so that a rotational ratio between the first rotor 13 and the second rotor 18 becomes 2:3, and the positions of teeth in the gear 13*b* of the first rotor 13 and the gear 22 of the second rotor 18 are decided so that each of the blades 15-1 through 15-3 intersects the blade 20-1 or 20-2** at the respective yarn-transfer positions A and B.

Figure 7:
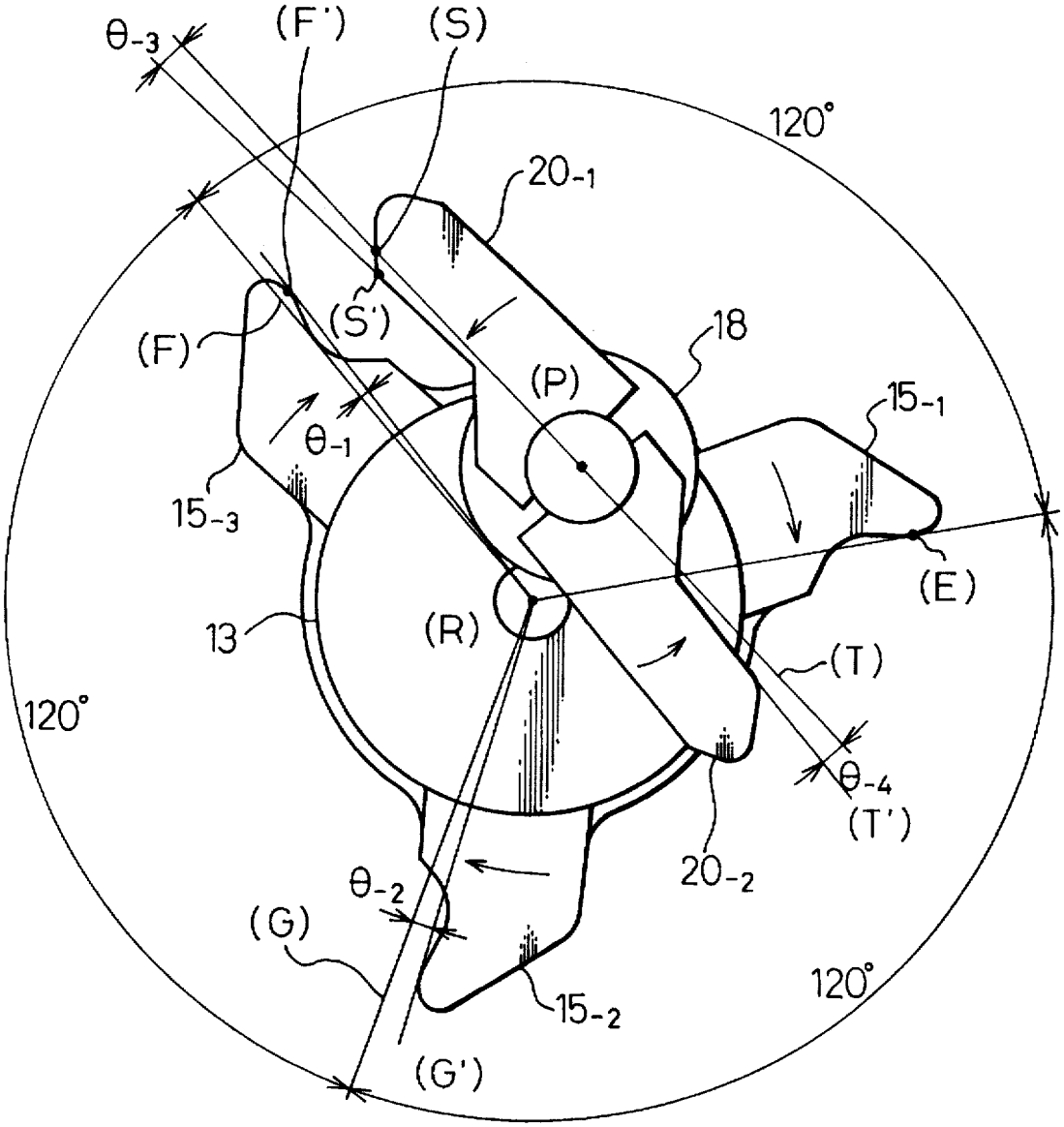
FIG. 7 is a diagrammatic view illustrating the positional relationship between the respective rotors, blades and yarn-guiding surface.

Next, while keeping the positional relationship between the points P, R, the yarn-guiding surface 23, the first rotor 13 and the second rotor 18 as it is, as shown in FIG. 7, the positions of the blades 15-1 through 15-3 and the blades 20-1 and 20-2 are actually regulated.

First, the blade 15-3 is moved clockwise to reduce the angle between the blades 15-1 and 15-3 to be less than 120° and fixed to the first rotor 13, while the blade 15-2 is moved counterclockwise to reduce the angle between the blades 15-1 and 15-2 to be less than 120° and fixed to the first rotor 13. Also the blades 20-1 and 20-2 are moved counterclockwise and clockwise, respectively, from the abovesaid positions and fixed to the second rotor 18.

That is, the blades 15-1 through 15-3 are positioned as follows; first a line RE connecting a point R in FIG. 7 with a point E on a yarn-guiding edge formed at a distal end of the blade 15-1 is defined as a reference line, then the blade 15-3 is rotated clockwise to touch a line RF' offset through θ-1 from a line RF offset counterclockwise through 120° from the line RE and fixed while the blade 15-2 is rotated to touch a line RG' offset counterclockwise through θ-2 from a line RG offset clockwise through 120° from the line RE and fixed.

On the other hand, the blades 20-1 and 20-2 are positioned as follows; first the line RE described above with reference to the blade 15-1 is defined as a reference line, then a point S is determined on a yarn-guiding edge formed at a distal end of the blade 20-1 when the blade 15-1 intersects the blade 20-1 at the yarn-transfer position A on the yarn-guiding surface 23 while maintaining a meshing state of the gear **13*b* of the first rotor 13 with the gear 22 of the second rotor 18, and a point T is determined on a yarn-guiding edge formed at a distal end of the blade 20-2 offset 180° from the point S. Next, a line STP connecting the point S with the point T is defined as another reference line, and the blade 20-2 is rotated to touch a line PT' offset clockwise through θ-4 from the line STP and fixed, while the blade 20-1** is rotated to touch a line PS' offset counterclockwise through θ-3 therefrom and fixed.

Although the abovesaid angles θ-1 through θ-4 may vary in accordance with yarn thickness, yarn kinds, yarn winding speed or others, distances between the points F,F'; G,G'; S,S'; and T,T' are preferably in a range of 0.5 mm through 3 mm.

The movements of the respective blades in the abovesaid traversing unit 6-1 will be explained below.

When the first rotor 13 rotates clockwise, a yarn is conveyed along the yarn-guiding surface 23 from the yarn-transfer position B to the yarn-transfer position A, and, when the blades 15-1 reaches the yarn-transfer point A and intersects the blade 20-1 of the second rotor 18 rotating counterclockwise, the yarn transfers from the blade 15-1 to the blade 20-1. Then the yarn is conveyed toward the yarn-transfer position B by the blade 20-1 and, when the blade 20-1 reaches the yarn-transfer position B and intersects the blade 15-3, the yarn transfers from the blades 20-1 to the blade 15-3. Thus one cycle of the yarn reciprocation is completed. The yarn is subsequently transferred from the blade 15-3 to the blade 20-2 at the yarn-transfer position A, from the blade 20-2 to the blade 15-2 at the position B, from the blade 15-2 to the blade 20-1 at the position A, from the blade 20-1 to the blade 15-1 at the position B, from the blade 15-1 to the blade 20-2 at the position A, from the blade 20-2 to the blade 15-3 at the position B, from the blade 15-3 to the blade 20-1 at the position A, from the blade 20-1 to the blade 15-2 at the position B, from the blade 15-2 to the blade 20-2 at the position A, and from the blade 20-2 to the blade 15-1 at the position B; thus the yarn returns to the initial state.

As described above, the yarn is subjected to a traverse motion on the yarn-guiding surface 23 by the subsequent transfers between the three blades 15-1 through 15-3 and the two blades 20-1 and 20-2.

Figure 8:
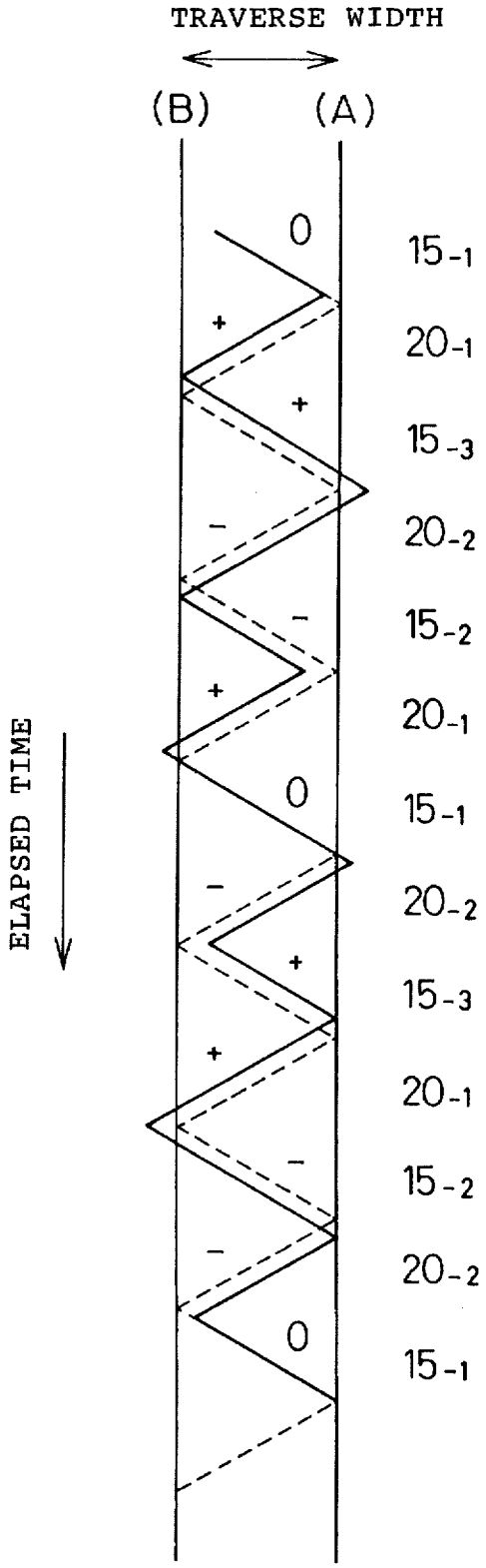
FIG. 8 is a diagrammatic view of yarn path when a yarn is traversed by the respective blades.

FIG. 8 illustrates the movement of the traversing yarn by the respective blades stated above, in which the ordinate represents a time passage and the abscissa represents a yarn position relative to a package width A through B.

In this connection, it is assumed that the blades 15-3 and 20-2 are offset to a plus side (+) and the blades 15-2 and 20-1 are offset to a minus side (−).

Since the blade 20-2 is offset to +, the blade 15-3 to − and the blade 15-2 to −, as shown in FIG. 8, the relationship between the time passage and the yarn position is one represented by a solid line, in which it is apparent that the turning points vary in a synchronized manner, compared to a case when no offsets exist, as represented by a dotted line.

Figure 9:
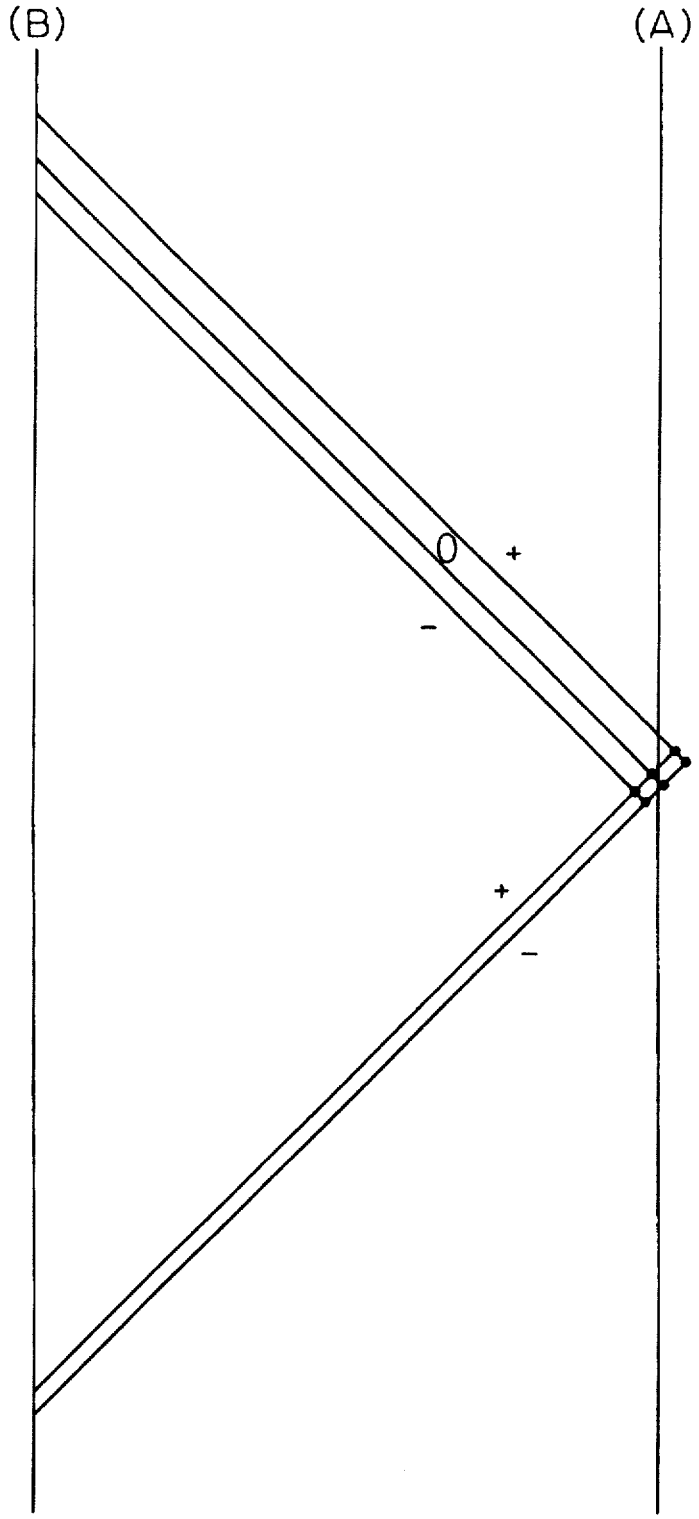
FIG. 9 is a diagrammatic view illustrating a change of yarn position at a turning point.

The variation of the yarn-transfer position between the respective blades is illustrated in FIG. 9, in which the yarn-transfer position from the blade offset to + to the blade offset to + is different from that from the former to the blade offset to −.

In this connection, if all the angles of θ-1 through θ-4 are different from each other, there are six turning points. That is, this is determined by a combination of one of three blades 15-1 through 15-3 and one of two blades 20-1 and 20-2; 3×2=6.

It is thus possible to obtain six kinds of turning points in this embodiment.

If three blades are combined with four blades and the offset angles thereof from the regular positions are different from each other, it is possible to obtain twelve kinds of turning points.

Instead of using different offset angles in the blades, it is possible, for the purpose of obtaining the same effect, to adopt blades having different shapes and/or lengths from each other so that the position of the yarn-guiding edge formed at a distal end of the respective blade is different from that obtained by equi-angularly dividing a circle on a rotary plane.

Although it is represented that the yarn sharply turns at a point in FIGS. 8 and 9, the turning motion is moderated when the yarn is in fact wound on the package, due to a free length between a contact point U on the yarn-guiding surface 23 and a contact point N on the touch roller 7 so that the yarn turns along a smooth curve defined in accordance with the shape of the yarn-guiding edge formed at a distal end of the respective blade.

Even if a package reaches a ribbon wind zone during the package formation, in which a ratio between a yarn traversing period and a package rotational speed coincides with an integer or a fraction of integer, for example, when the package makes two rotations during one reciprocation of yarn, a yarn trace on the package surface returns to the initial trace only after the yarn repeats six reciprocations, whereby the growth of ribbon wind is retarded and a yarn loop is prevented from slipping off from the package during the unwinding process.

Figure 10:
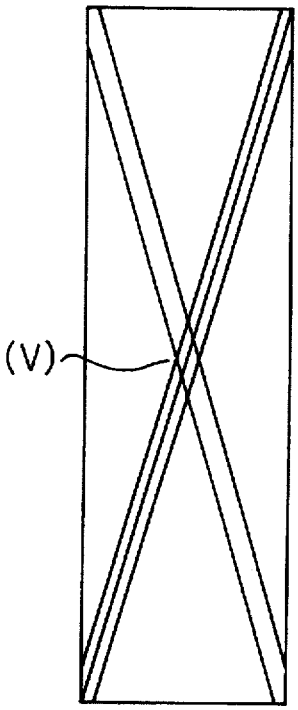
FIG. 10 is a diagrammatic view illustrating a cross-winding state of yarn in a secondary ribbon wind phase.

This will be clearly understood from the development of secondary ribbon wind shown in FIG. 10, in which the yarn traces intersect each other at six points V whereby a speed of ribbon growth in the thickness direction becomes one sixth compared with that resulted without the blade offset. In addition, the yarn traces do not overlap with each other at the opposite ends of the traversing stroke whereby a yarn portion to be unwound in the next time is prevented from being withdrawn simultaneously with a yarn portion now being unwound. Accordingly, it is possible to avoid the generation of abrupt tension variation during the unwinding process and release a yarn at a high speed.

When the two blades are combined with the three blades as stated above, a distance between the rotational center R of the first rotor 13 and that P of the second rotor 18 becomes about one third of the traversing stroke. Accordingly, assuming the traverse stroke is 123 mm, a distance between axes of first and second rotors 13, 18 is about 42 mm; and assuming the traversing stroke is 85 mm, the distance between the axes is about 30 mm, which means that the rotation can be transmitted between both the rotors by the direct intermeshing of gears provided on the respective rotors.

Figure 11:
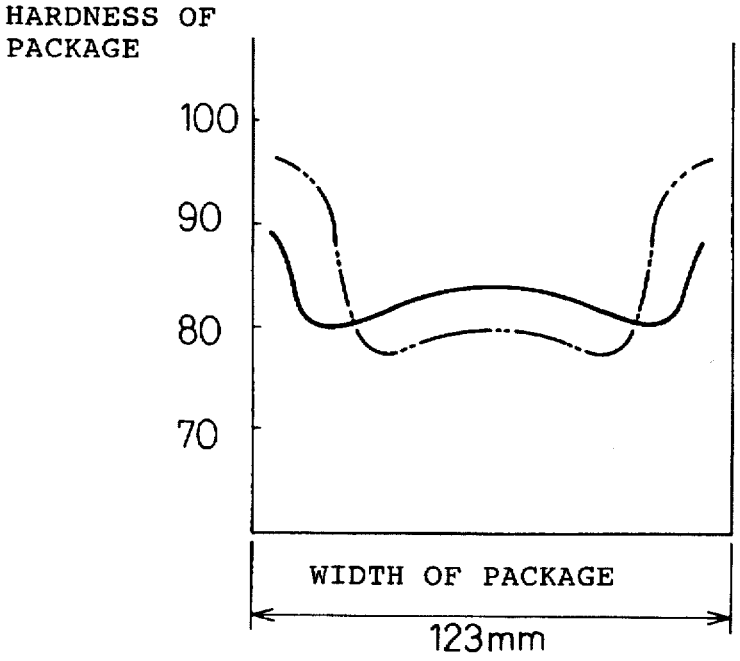
FIG. 11 is a diagrammatic view illustrating a distribution of package hardness.

FIG. 11 shows hardness distributions measured by a hardness tester of JIS A type in two packages of polyester yarn (75 denier/36 filaments) formed by the abovesaid traverse-motion mechanism under the conditions of a traversing stroke of 123 mm, a winding angle of 5.7°, a winding speed of 3100 m/min, and a final package diameter of 420 mm; one being wound with the blades at regular positions and the other being wound with the blades offset about 1 mm from the former. It is apparent from the results that, when the blades are offset from the regular positions (represented by a solid line), a difference of hardness is less than that when the blades are at the regular positions (represented by a chain line).

A selvage rise (α) and a lateral bulge (β) are listed in Table 1, both of which are minimized when the blades are offset.

The numbers of blades provided on the first and second rotors 13, 18 are prefearbly a combination of odd and even numbers, respectively, such as two and three or three and four, so that more turning points can be obtained using fewer blades.

A pitch L between the adjacent traversing units is 269 mm from the following equation (2) if the respective traversing units 6-1 through 6-4 are linearly installed, when it is assumed that a traversing stroke W is 250 mm, a blade diameter D is 250 mm, a shaft diameter d is 30 mm, an eccentric distance e is 95 mm and an offset angle θ is 8°:

$$L = \sqrt{[(D+d)/2]^2 - [e \times \sin(90° - \theta)]^2} \quad (2)$$

$$l = \sqrt{[(540+30)/2]^2 - [95 \times \sin(90° - 8)]^2}$$

$$= 269 \text{ (mm)}$$

Figure 14:
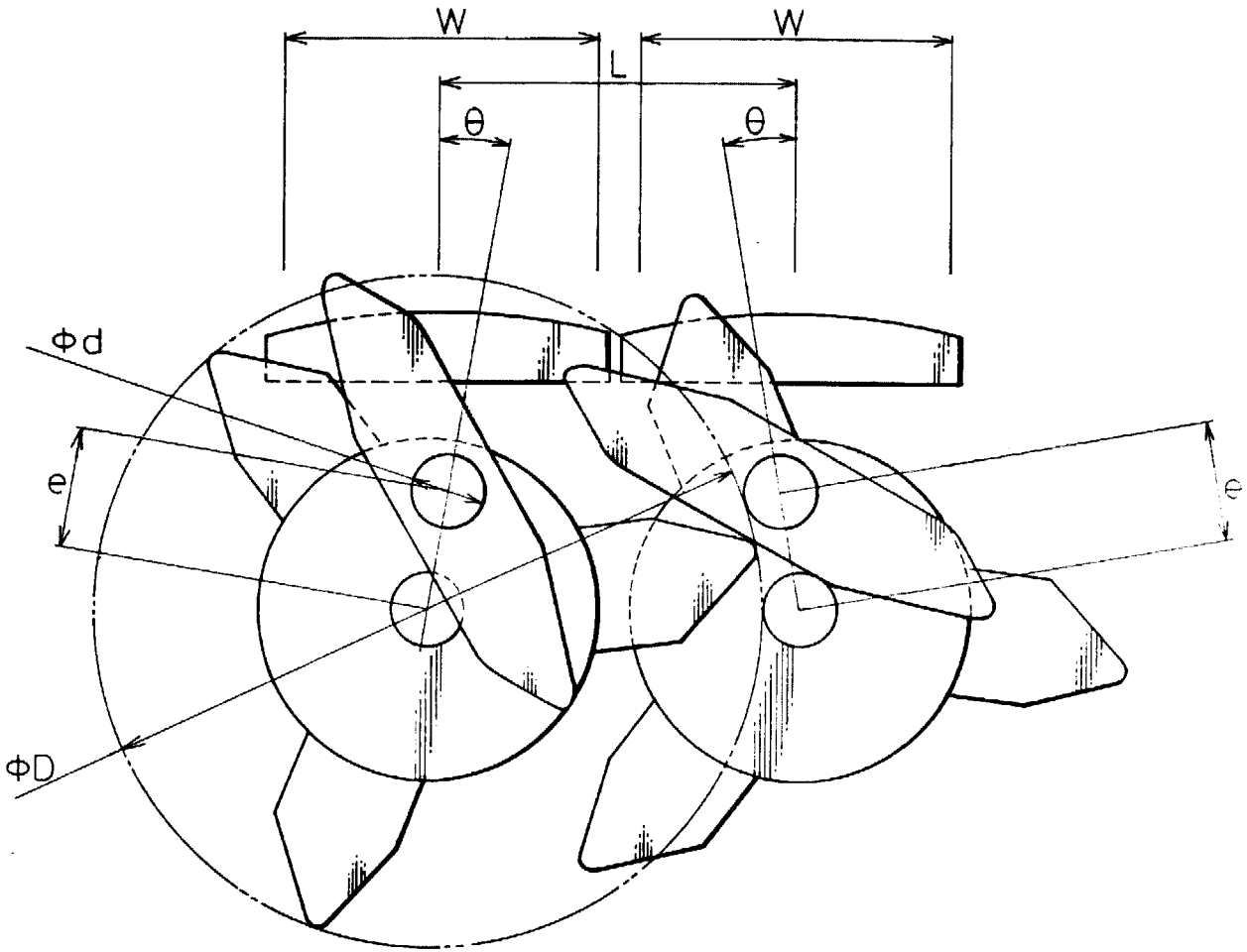
FIG. 14 is a diagrammatic view illustrating dimensions relating to a pitch between the adjacent traversing units in FIG. 5.
Figure 15:
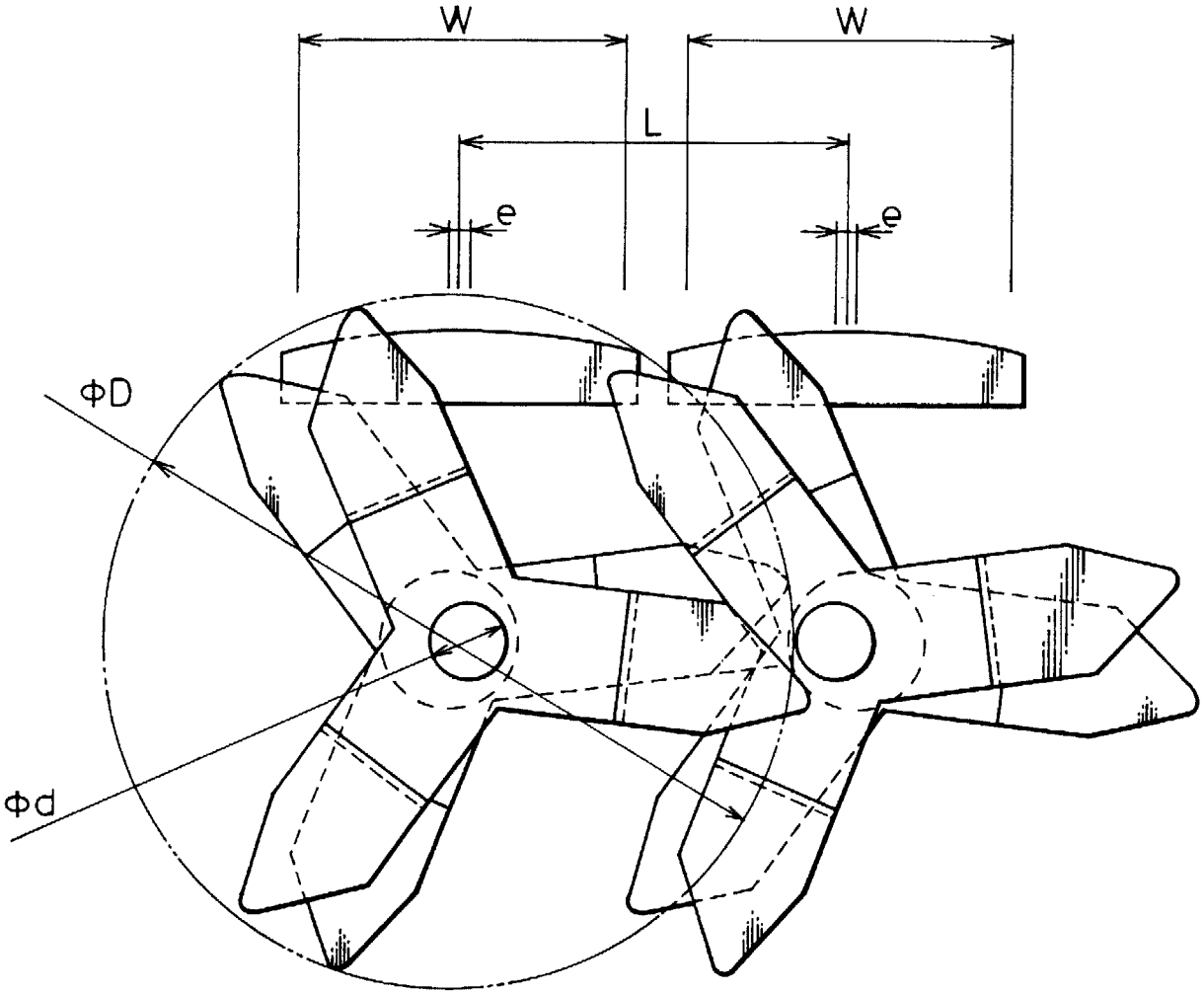
FIG. 15 is a diagrammatic view illustrating dimensions relating to a pitch between the adjacent traversing units of the conventional traverse-motion mechanism.

This pitch L between the adjacent traversing units is 5.5% shorter than that in the conventional traversing units shown in FIG. 14.

Figure 12:
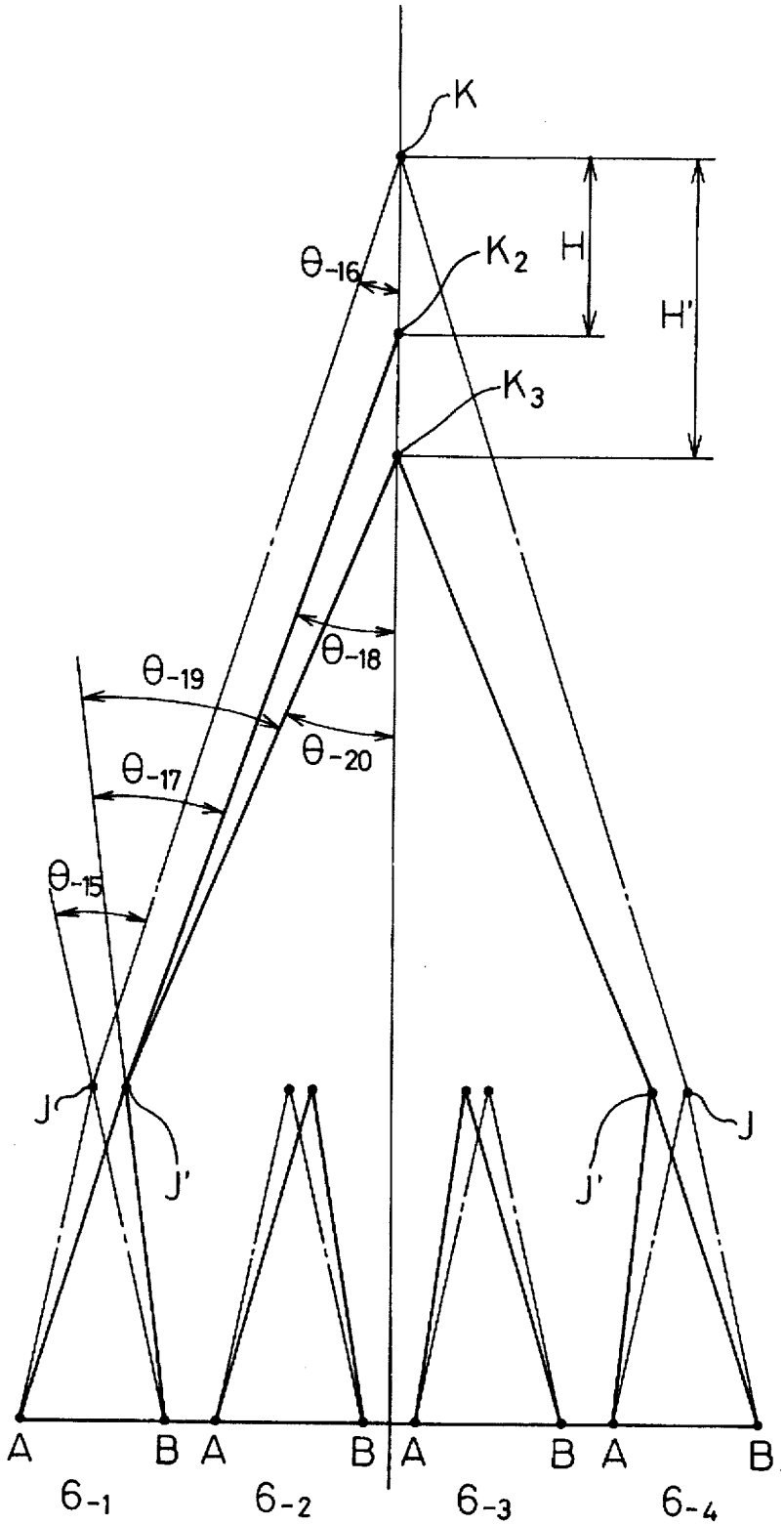
FIG. 12 is a diagrammatic view illustrating a positional relationship between a yarn-separating fulcrum, a yarn-traversing fulcrum and traverse ends in the yarn-guiding surface.

Next, the operation will be explained with reference to FIG. 12, for positioning the respective traversing units 16-1 through 16-4, the yarn-traversing fulcrums 35-1 through 35-4 and the yarn-separating fulcrum 35.

Assuming that the yarn-traversing fulcrum 35-1 is located at a position J straight above the center of traversing path of the traversing unit 6-1 and the yarn-separating fulcrum 36 is located at a position K straight above the center between the yarn-traversing fulcrums 35-1 and 35-4, a yarn bending angle θ-15 made by the traverse end position B, the position J of the yarn-traversing fulcrum 35-1 and the position K of the yarn-separating fulcrum 36 is prefearbly about 20° to not increase a resistance against the running yarn and to prevent the fluctuation of a yarn tension from occurring in the upstream region.

Accordingly, the position K of the yarn-separating fulcrum 36 is decided so that the yarn bending angle θ-15 made by the traverse end position B of the traversing unit 6-1, the position J of the yarn-traversing fulcrum 35-1 and the position K of the yarn-separating fulcrum 36 is 20° and the yarn bending angle θ-15 made by the traverse end position A of the traversing unit 6-4, the position J of the yarn-traversing fulcrum 35-4 and the position K of the yarn-separating fulcrum 36 is 20°.

Then the traversing units 6-1 and 6-2 are made to offset clockwise through θ-11 and θ-12, respectively, in a plane shown in FIG. 2 substantially vertical to the running yarn at a position where the yarn is in contact with the traverse guide, and the traversing units 6-3 and 6-4 are made to offset counterclockwise, i.e., in the reverse direction to the traversing units 6-1 and 6-2, through θ-13 and θ-14, respectively. The above positioning operation of traversing units is carried out by sliding the respective support 10 along the arcuate stepped portion 5*a* formed on the frame body 5 and fixing the same on the frame body 5 by the screws 11.

Figure 13:
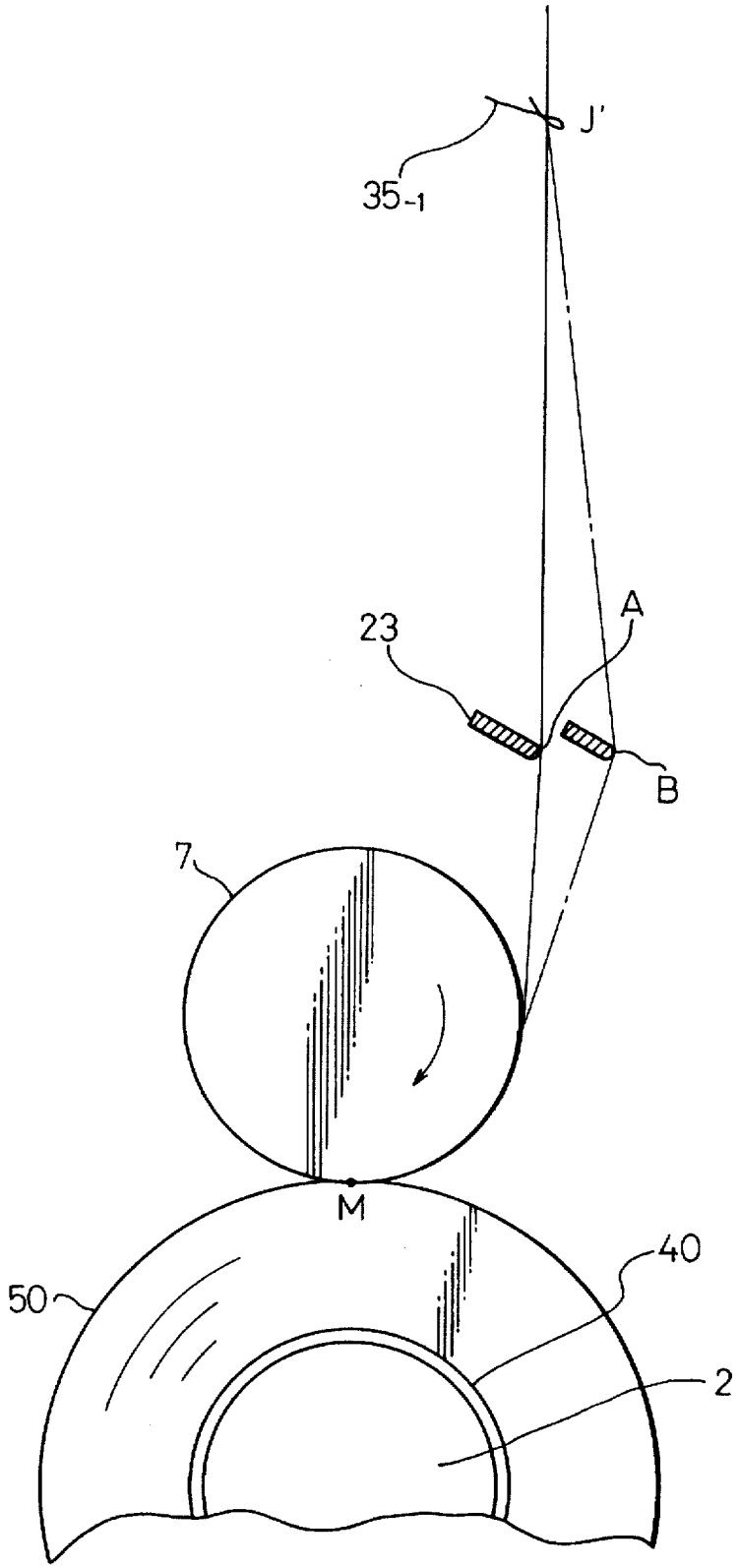
FIG. 13 is a diagrammatic view illustrating a yarn-guiding position at the traverse end in the yarn-guiding surface when the traversing unit is offset.

Since the traversing unit 6-1 is fixed at a position offset clockwise through θ-11 as shown in FIGS. 2 and 4, yarn-touching points at the traverse ends A, B are deviated in the lateral direction as shown in FIG. 13.

Accordingly, a position J' of the yarn-traversing fulcrum 35-1 is decided at first so that a length of a yarn path J'-A-M becomes equal to a length of a yarn path J'-B-M.

Then a position K2 of the yarn-separating fulcrum 36 is decided so that a sum of yarn bending angles θ-17 and θ-18 made by the position B of the traverse end, the position J' of the yarn-traversing fulcrum 35-1 and the position K of the yarn-separating fulcrum 36 is equal to a sum of the yarn bending angles θ-15 and θ-16.

The position K2 of the yarn-separating fulcrum 36 when the traversing unit 6-1 is offset clockwise as described above is H mm lower than the position K of the yarn-separating fulcrum when the traversing unit 6-1 is not offset.

When no modification is made on the maximum yarn bending angle θ-15 on the yarn path, i.e., θ-15 =θ-19, the abovesaid position K2 of the yarn-separating fulcrum 36 shifts to a position K3 lower H' mm than the original position K of the yarn-separating fulcrum 36. A yarn bending angle θ20 at the position K3 of the yarn-separating fulcrum 36 is larger than the yarn bending angle θ-16 at the position K of the yarn-separating fulcrum 36, but the yarn bending angle θ-18 is smaller than the yarn bending angle θ-19, whereby the maximum yarn bending angle becomes θ-19 similar to the case when the traversing unit is not offset.

In the above-described apparatus for winding a plurality of yarns, if it is assumed that the number of the traversing units is four, the traversing stroke is 200 mm, the pitch between the adjacent traversing units is 230 mm and the offset angles θ-11 and θ-14 of the traversing units 6-1 and 6-4, respectively, are 2.5°, it is possible to shift the positions J' of the yarn-traversing fulcrums 35-1 and 35-4 28.2 mm closer to the center, and if the yarn bending angle θ-19 at the yarn-traversing fulcrum 35-1 or 35-4 is 20°, the vatical distance between the position J' of the yarn-traversing fulcrum 35-1 or 35-4 and the position K3 of the yarn-separating fulcrum 36 becomes 1353 mm, which is 502 mm less than the distance 1855 mm in the conventional case when the traversing unit is not offset.

At that time, although the traversing stroke is reduced by offsetting the traversing unit 6-1 2.5° from 6-4, the reduction is negligibly small as follows:

$$(1-\cos 2.5°) \times 200 = 0.2 \ (mm)$$

If it is assumed that the number of traversing units is eight, the traversing stroke is 123 mm, the pitch between the adjacent traversing units is 153 mm and the offset angles θ-11 and θ-14 of the traversing units 6-1 and 6-4, respectively, are 2.5°, it is possible to shift the positions J' of the yarn-traversing fulcrums 35-1 and 35-4 12 mm closer to the center, and if the yarn bending angle θ-19 at the yarn-traversing fulcrum 35-1 or 35-4 is 20°, a height distance between the position J' of the yarn-traversing fulcrum 35-1 or 35-4 and the position K3 of the yarn-separating fulcrum 36 becomes 2390 mm, which is 490 mm lower than the distance 2880 mm in the conventional case when the traversing unit is not offset.

When the yarn-separating fulcrum 36 is at a higher position, a smaller yarn bending angle is obtainable.

As stated above, in the apparatus for winding a plurality of yarns according to the present invention, since the traversing unit provided at one of opposite ends thereof is offset in a plane intersecting the yarn running while being in contact with the traverse guiding element, so that a straight line connecting the opposite ends of the traversing zone is not parallel to an axis of the touch roller, a traversing center of the yarn-guiding surface can be displaced closer to another traversing unit disposed on the other side. Thereby an upstream distance from the yarn-traversing fulcrum to the yarn-separating fulcrum or the godet roller can be shortened while maintaining the yarn bending angle at the yarn-traversing fulcrum is as it is, which results in the reduction of overall height of the apparatus, whereby it is possible to ease the threading operation as well as to install the apparatus in a conventional low ceiling building.

Since the traverse-motion mechanism according to one embodiment of the present invention is formed so that m blades (m≠n) are attached to the first rotor, one traversing unit is symmetrical to the adjacent one relative to an axis vertical to the traverse direction, the first and second rotors in one traversing unit respectively rotate in reverse to those in the adjacent traversing unit, and an axis of the first rotor is distant from an axis of the second rotor in the direction substantially vertical to an axis of the bobbin carrying spindle, it is possible for any one package to be necessarily and sufficiently closer to the adjacent package to avoid the use of the unnecessarily longer bobbin and spindle.

Also, according to the present invention, since the traversing unit is formed by a pair of rotors rotatably carried on a frame body, a plurality of blades fixed to the respective rotor and a yarn-guiding surface attached onto the frame body to conform with the rotary path of the blades, is possible to make the overall structure thereof in a simple manner.

According to further embodiment of the present invention, since the traversing unit is formed so that the numbers of blades attached to the first and second rotors are m and n ($m \neq n$), respectively, and a rotational ratio of the first rotor relative to the second rotor is n:m; the blades being arranged in an equiangular manner on the respective circle depicted in a rotary plane thereof while positioning the rotary centers of the first and second rotors so that the rotary angle, through which one blade on the one rotor guides the yarn along the yarn-guiding surface to transfer the same to another blade on the other rotor, is about 360°/2 m in the first rotor and about 360°/2 n in the second rotor; it is possible to increase the interaxial distance between the first and second rotors and to drive the respective rotor directly by the other rotor without providing an intermediate gear or the like, resulting in a simple structure and there reduction of time required for the parts-manufacturing operation, assembling operation and maintenance operation.

While, if the traversing unit according to the present invention is formed so that the numbers of blades attached to the first and second rotors are m and n ($m \neq n$), respectively and the blades are arranged on the respective rotor so that the yarn-guiding edge provided at a distal end of the blade is offset from the equiangularly-divided position on the respective circle depicted in a rotary plane thereof, it is possible to obtain more than six yarn turning points and minimizing the rise of package selvage and the generation of ribbon wind so that the product quality is not influenced thereby.

If the respective blade is attached to the first and second rotors in a position-adjustable manner along an arcuate stepped portion formed in the respective rotor, it is possible to readily vary the yarn turning position.

TABLE 1

| Offset of Blade | Rise of Selvage (α) | Bulge Amount (β) |
|---|---|---|
| Yes | 0 (mm) | 2 (mm) |
| No | 1 (mm) | 4 (mm) |

We claim:

1. In an apparatus for winding a plurality of running yarns, wherein said apparatus includes a spindle having an axial direction; bobbins mounted on said spindle; a machine frame for rotatably supporting said spindle; a frame body movably connected to said machine frame; a touch roller rotatably attached to said frame body and adjacent to said bobbins on said spindle, said touch roller being arranged to apply contact pressure to said bobbins, said touch roller also having an axis of rotation which is parallel to said spindle axis; a traverse-motion mechanism also supported by said frame body and having a plurality of yarn traversing units arranged at spacings from one another in a row in said axial direction of said spindle for obtaining traverse movement of the respective yarns, said yarn traversing units including two endmost yarn traversing units defining either end of said row of yarn traversing units; each of said yarn traversing units comprising a yarn guiding member extending in a plane in parallel to the axis of the spindle shaft while contacting a running yarn, so that a yarn guiding surface is defined at a peripheral end of the yarn guiding member, and a yarn traversing means positioned upstream from said touch roller and in the vicinity of the corresponding yarn guiding surface, the yarn traversing means being arranged to reciprocate the corresponding yarn along a traversal path on the corresponding yarn guiding surface, the yarn guiding surface being in a position such that a straight line connecting the opposite ends of the traverse path on the guiding surface is parallel to the spindle axis; a yarn separating guide defining a yarn separating fulcrum and positioned between endmost yarn traversing units and upstream from the row of yarn traversing units; yarn bending guides, each defining a yarn traversing fulcrum and positioned between said yarn separating fulcrum and the respective yarn traversing units, wherein said yarns are separated from each other at the yarn separating fulcrum and are, via the yarn traversing guides and the traversing units, supplied to and wound on the respective bobbins on the spindle, the combination wherein:

said yarn guiding member of at least one of the endmost traversing units is rotatable about an axis which is transverse to said plane of the corresponding yarn guiding member, and is rotated an angular distance θ so that said straight line connecting the opposite ends of the traverse path on the guiding surface is positioned at an angle corresponding to said angular distance θ to said spindle axis, and said yarn traversing fulcrum being positioned a predetermined length in a direction downstream from the yarn separating fulcrum.

2. An apparatus for winding a plurality of yarns as defined in claim 1, wherein said yarn traversing means comprises a first and second rotors, each of said first and second rotors being rotatably secured on said frame body, and a plurality of blades fixed on each of said first and second rotors so as to define rotary blade paths for each of the first and second rotors, said first and second rotors being rotated in opposite directions to obtain the reciprocated movement of the corresponding yarn when the latter is engaged with the blades in said rotary blade paths.

3. In a traverse-motion mechanism in an apparatus for winding a plurality of running yarns, wherein said apparatus includes a spindle having an axial direction; bobbins mounted on said spindle; a machine frame for rotatably supporting said spindle; a frame body movably connected to said machine frame; a touch roller rotatably attached to said frame body adjacent to said bobbins and arranged to apply contact pressure to said bobbins, said touch roller having an axis of rotation which is in parallel to the spindle axis; said traverse mechanism also being supported by said frame body, said traverse-motion mechanism including a plurality of traversing units; each of said traversing units comprising first and second rotors, said first rotor being rotatably secured on said frame body about a first rotor axis, said second rotor being rotatably secured on said frame body about a second rotor axis, a plurality of blades being fixed to each of said first and second rotors so as to define rotary blade paths for each of said first and second rotors, the first and second rotors being rotated in opposite directions so as to obtain a traverse movement of the corresponding running yarn in a direction parallel to the spindle axis, when the running yarn is engaged with the blades in the rotary blade paths; said traversing units being arranged in pairs which are adjacent with each other in said axial direction of the spindle;

the combination wherein:

said traversing units in each of the pairs are arranged substantially symmetrical with respect to a direction transverse to the traverse movement of the running yarn, said first rotor has m blades and said second rotor has n blades, m and n being different integers, said first rotor axis and said second rotor axis being eccentric with respect to each other such that a line connecting said first and second rotor axes of a traversing unit is transverse to the spindle axis.

4. An apparatus according to claim 3, wherein said symmetrical arrangement of each of the pairs of the traversing units is such that a distance between the axes of the shafts on which the rotary blades of a smaller number of the blades are mounted is different from a distance between the axes of the shafts on which the rotary blades of a larger number of the blades are mounted.

5. An apparatus according to claim 3, wherein, in said traversing units in each of the pairs, rotational directions of the first and second rotors in one of the units are opposite to rotational directions of the first and second rotors, respectively, in the other units.

6. In a traversing unit for traversing a running yarn, said traversing unit comprising a frame body, a yarn guiding surface mounted on said frame body and being constructed and arranged to guide said running yarn along a yarn traversal path, a first rotor rotatably mounted on said frame body and about a first rotor axis, a second rotor rotatably mounted on said frame body about a second rotor axis, a plurality of blades fixed on each of said first and second rotors so as to define rotary blade paths for each of said first and second rotors, wherein said first and second rotors rotate in opposite directions at a rotational ratio such that said running yarn is conveyed over a first angular distance along said yarn traversal path by one of said blades of said first rotor in one of said opposite directions to be received by one of said blades of said second rotor to convey said running yarn over a second angular distance along said yarn traversal path in the other of said opposite directions, the combination wherein:

the number of said blades on said first rotor is m and the number of said blades on said second rotor is n, m and n being different integers; each of said blades fixed to a given rotor being arranged at an equiangular position relative to other of said blades fixed to the same rotor; said first rotor axis and said second rotor axis being arranged so that said first angular distance is about 360°/2 m and said second angular distance is about 360°/2 n; and said rotational ratio of said first rotor relative to said second rotor is n:m.

7. In a traversing unit for traversing a running yarn, said traversing unit comprising a frame body; first and second rotors each rotatably mounted on said frame body; a plurality of blades fixed on each of said first and second rotors so as to define rotary blade paths for each of said first and second rotors; each of said blades comprising a distal end having a yarn guiding edge formed thereon; a yarn guiding surface mounted on said frame body being constructed and arranged to guide said running yarn along a yarn traversal path; wherein said first and second rotors rotate in opposite directions such that said running yarn is conveyed along said yarn traversal path by one of said blades of said first rotor in one of said opposite directions to be received by one of said blades of said second rotor to convey said running yarn along said yarn traversal path in the other of said opposite directions, the combination wherein:

the number of said blades on said first rotor is m and the number of said blades on said second rotor is n, m and n being different integers; said yarn guiding edge being arranged at a non-equiangular position relative to other yarn guiding edges of said blades on a given rotor.

8. A traversing unit as defined in claims 6 or 7, wherein said first and second rotors each further comprise an arcuate portion, and wherein said blades are position adjustable in relation to said arcuate portion on the rotor to which said blades are attached.

* * * * *